US009105956B2

(12) United States Patent
Huang et al.

(10) Patent No.: US 9,105,956 B2
(45) Date of Patent: Aug. 11, 2015

(54) LAMINATED WAVEGUIDE DIPLEXER WITH SHIELDED SIGNAL-COUPLING STRUCTURE

(71) Applicant: MICROELECTRONICS TECHNOLOGY, INC., Hsinchu (TW)

(72) Inventors: Ting Yi Huang, Taipei (TW); Chia Yu Chou, Hsinchu (TW)

(73) Assignee: Microelectronics Technology, Inc., Hsinchu (TW)

( * ) Notice: Subject to any disclaimer, the term of this patent is extended or adjusted under 35 U.S.C. 154(b) by 26 days.

(21) Appl. No.: 14/081,694

(22) Filed: Nov. 15, 2013

(65) Prior Publication Data

US 2014/0184355 A1 Jul. 3, 2014

Related U.S. Application Data

(60) Provisional application No. 61/769,520, filed on Feb. 26, 2013.

(51) Int. Cl.

| | |
|---|---|
| ***H01P 3/12*** | (2006.01) |
| ***H01P 1/213*** | (2006.01) |
| *H01P 5/107* | (2006.01) |

(52) U.S. Cl.

CPC ..... *H01P 1/2138* (2013.01); *H01P 5/107* (2013.01)

(58) Field of Classification Search

USPC ..... 333/239, 248, 125–126, 132; 343/771–772, 767

See application file for complete search history.

(56) References Cited

U.S. PATENT DOCUMENTS 7,276,987 B2 * 10/2007 Koriyama ..... 333/26

OTHER PUBLICATIONS

Deslandes et al., "Single-Substrate Integration Technique of Planar Circuits and Waveguide Filters," IEEE Transactions on Microwave Theory and Techniques, vol. 51, No. 2, pp. 593-596, Feb. 2003.

Huang et al., "CH.11 Design and Modeling of Microstrip Line to Substrate Integrated Waveguide Transitions," Passive Microwave Components and Antennas, ISBN 978-953-307-083-4, pp. 225-246, Apr. 1, 2010.

Qiu et al., "A Novel Millimeter-Wave Substrate Integrated Waveguide (SIW) Filter buried in LTCC," Asia-Pacific Microwave Conference, pp. 1-4, Dec. 16-20, 2008.

* cited by examiner

*Primary Examiner* — An Luu

(74) *Attorney, Agent, or Firm* — Hamre, Schumann, Mueller & Larson, P.C.

(57) ABSTRACT

A laminated waveguide diplexer includes an upper conductive layer having a first slot and a second slot; a first line crossing over the first slot; a first shielding conductor disposed over the first line; a plurality of first conductive pillars connecting the upper conductive layer and the first shielding conductor; a second line crossing over the second slot; a second shielding conductor disposed over the second line; and a plurality of second conductive pillars connecting the upper conductive layer and the second shielding conductor.

18 Claims, 13 Drawing Sheets

LAMINATED WAVEGUIDE DIPLEXER WITH SHIELDED SIGNAL-COUPLING STRUCTURE

FIELD OF THE INVENTION

The present disclosure relates to a laminated waveguide diplexer with a shielded signal-coupling structure for transmitting and receiving radio frequency signals on different frequency bands.

DISCUSSION OF THE BACKGROUND

Wireless communication systems are widely deployed to provide various communication content such as voice, video, packet data, messaging, broadcast, etc. These wireless systems may be multiple-access systems capable of supporting multiple users by sharing the available system resources. Examples of such multiple-access systems include Code Division Multiple Access (CDMA) systems, Time Division Multiple Access (TDMA) systems, Frequency Division Multiple Access (FDMA) systems, Orthogonal FDMA (OFDMA) systems, and Single-Carrier FDMA (SC-FDMA) systems.

In some communication systems, it is highly desirable to operate in two widely separated frequency bands instead of a single frequency band. This is due to the cost of implementing communication systems to meet system requirements, such as power, bandwidth, and federal regulatory limitations.

This "Discussion of the Background" section is provided for background information only. The statements in this "Discussion of the Background" are not an admission that the subject matter disclosed in this "Discussion of the Background" section constitutes prior art to the present disclosure, and no part of this "Discussion of the Background" section may be used as an admission that any part of this application, including this "Discussion of the Background" section, constitutes prior art to the present disclosure.

SUMMARY

One aspect of the present disclosure provides a laminated waveguide diplexer with a shielded signal-coupling structure for transmitting and receiving radio frequency signals on different frequency bands.

A laminated waveguide diplexer according to this aspect of the present disclosure comprises an upper conductive layer having a first slot and a second slot; a first line crossing over the first slot; a first shielding conductor disposed over the first line; a plurality of first conductive pillars connecting the upper conductive layer and the first shielding conductor; a second line crossing over the second slot; a second shielding conductor disposed over the second line; and a plurality of second conductive pillars connecting the upper conductive layer and the second shielding conductor.

The first shielding conductor and the first conductive pillars form a first shielded signal-coupling structure for a signal line (the first line) of a first laminated waveguide; similarly, the second shielding conductor and the second conductive pillars form a second shielded signal-coupling structure for a signal line (the second line) of a second laminated waveguide.

Due to the utilization of the shielding conductors over the signal lines of the laminated waveguide diplexer, the first radio frequency signals propagating through the first laminated waveguide are substantially not influenced by the second radio frequency signals propagating through the second laminated waveguide, and the second radio frequency signals propagating through the second laminated waveguide are substantially not influenced by the first radio frequency signals propagating through the first laminated waveguide. As a result, the laminated waveguide diplexer can operate in two separated frequency bands instead of a single frequency band; for example, the laminated waveguide diplexer can use one of the two laminated waveguides to receive the radio frequency signals on a first frequency band and use another laminated waveguide to transmit the radio frequency signals on a second frequency band.

The foregoing has outlined rather broadly the features and technical advantages of the present disclosure in order that the detailed description of the disclosure that follows may be better understood. Additional features and advantages of the disclosure will be described hereinafter, which form the subject of the claims of the disclosure. It should be appreciated by those skilled in the art that the conception and specific embodiment disclosed may be readily utilized as a basis for modifying or designing other structures or processes for carrying out the same purposes of the present disclosure. It should also be realized by those skilled in the art that such equivalent constructions do not depart from the spirit and scope of the disclosure as set forth in the appended claims.

BRIEF DESCRIPTION OF THE DRAWINGS

A more complete understanding of the present disclosure may be derived by referring to the detailed description and claims when considered in connection with the Figures, where like reference numbers refer to similar elements throughout the Figures, and:

DETAILED DESCRIPTION

The following description of the disclosure accompanies drawings, which are incorporated in and constitute a part of this specification, and illustrate embodiments of the disclosure, but the disclosure is not limited to the embodiments. In addition, the following embodiments can be properly integrated to complete another embodiment.

References to "one embodiment," "an embodiment," "exemplary embodiment," "other embodiments," "another embodiment," etc. indicate that the embodiment(s) of the disclosure so described may include a particular feature, structure, or characteristic, but not every embodiment necessarily includes the particular feature, structure, or characteristic. Further, repeated use of the phrase "in the embodiment" does not necessarily refer to the same embodiment, although it may.

The term "coupled with," along with its derivatives, may be used herein. "Coupled" may mean one or more of the following. "Coupled" may mean that two or more elements are in direct physical or electrical contact. However, "coupled" may also mean that two or more elements indirectly contact each other, but still cooperate or interact with each other, and may mean that one or more other elements are coupled or connected between the elements that are said to be coupled to each other.

The present disclosure is directed to a laminated waveguide diplexer with a shielded signal-coupling structure for transmitting and receiving radio frequency signals on different frequency bands. In order to make the present disclosure completely comprehensible, detailed steps and structures are provided in the following description. Obviously, implementation of the present disclosure does not limit special details known by persons skilled in the art. In addition, known structures and steps are not described in detail, so as not to limit the present disclosure unnecessarily. Preferred embodiments of the present disclosure will be described below in detail. However, in addition to the detailed description, the present disclosure may also be widely implemented in other embodiments. The scope of the present disclosure is not limited to the detailed description, and is defined by the claims.

Figure 1:
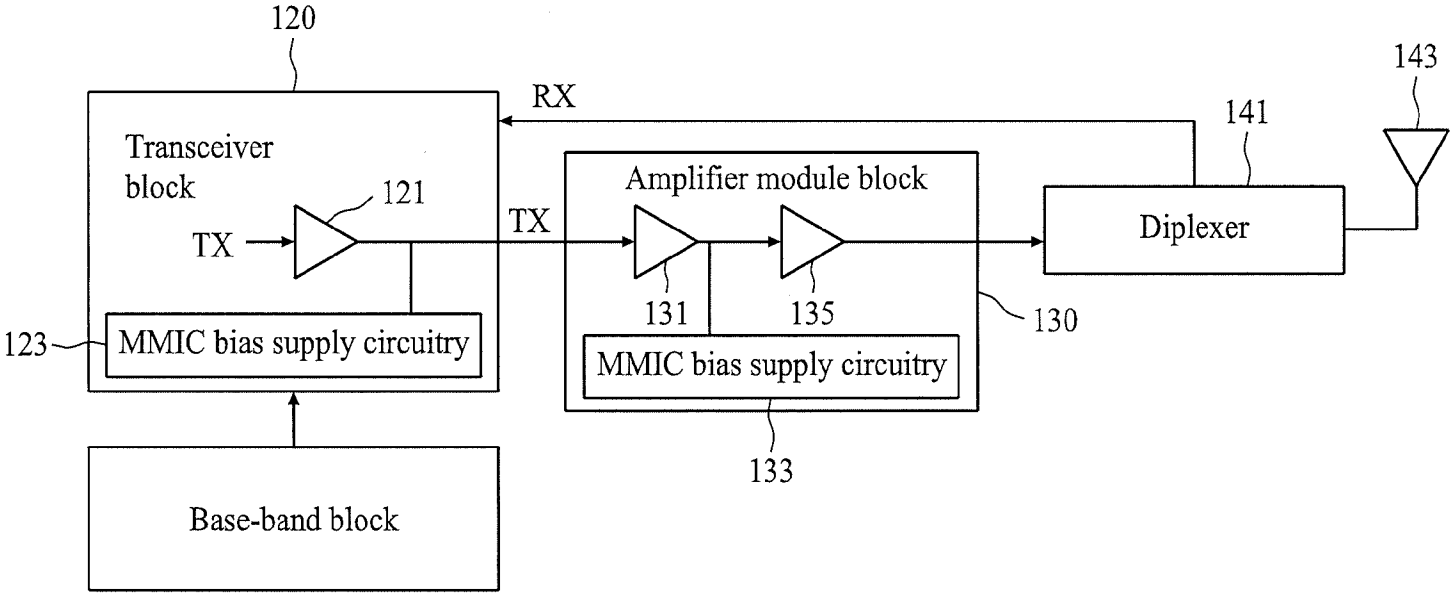
FIG. 1 shows an RF lineup block diagram depicting amplification of the RF signals.

FIG. 1 shows an RF (radio frequency) lineup block diagram which depicts the RF signals being amplified from a transceiver block 120 to an amplifier module block 130 and radiated to an antenna 143 through a diplexer 141. The transceiver block 120 includes an MMIC (Monolithic Microwave Integrated Circuit) gain block amplifier 121 and an MMIC bias supply circuitry 123, and the amplifier module block 130 includes an MMIC gain block amplifier 131, an MMIC bias supply circuitry 133, and a high power amplifier 135. The MMIC gain block amplifier 131 of the amplifier module block 130 is connected to the output of the MMIC gain block amplifier 121 of the transceiver block 120. Some applications may, among others, use two or more MMIC gain block amplifiers in parallel to generate more power with higher linearity.

Figure 2:
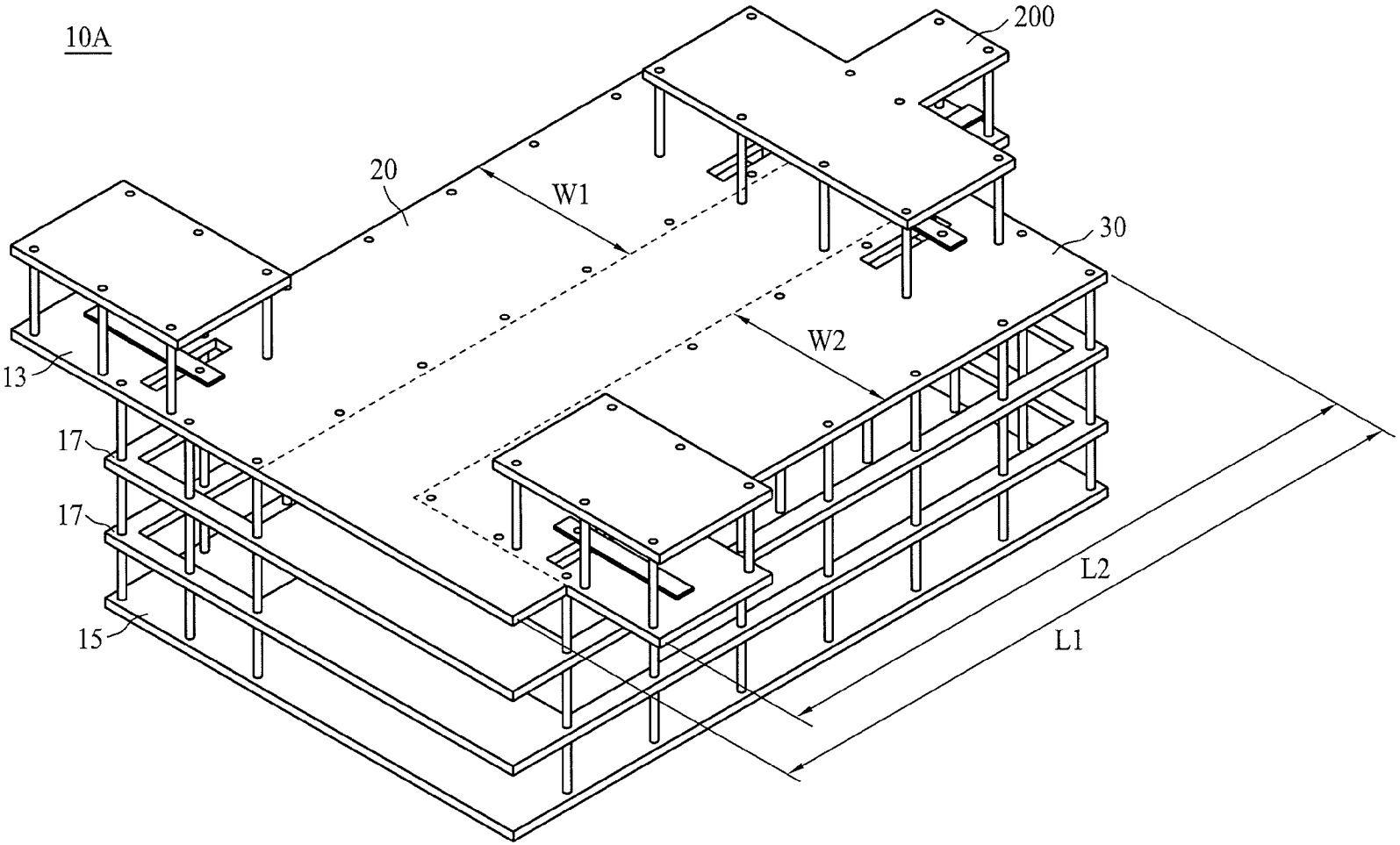
FIG. 2 illustrate a schematic view of a laminated waveguide diplexer for transmitting and receiving radio frequency signals on different frequency bands according to some embodiments of the present disclosure.

FIG. 2 illustrates a schematic view of a laminated waveguide diplexer 10A for transmitting and receiving radio frequency signals on different frequency bands according to some embodiments of the present disclosure, wherein the diplexer 141 in FIG. 1 can be implemented by the laminated waveguide diplexer 10A. In some embodiments of the present disclosure, the laminated waveguide diplexer 10A comprises a first laminated waveguide 20 and a second laminated waveguide 30.

In some embodiments of the present disclosure, the laminated waveguide diplexer 10A comprises an upper conductive layer 13, a bottom conductive layer 15, and at least one intervening conductive layer 17 disposed between the upper conductive layer 13 and the bottom conductive layer 15, wherein the first laminated waveguide 20 and the second laminated waveguide 30 are implemented in the upper conductive layer 13, the bottom conductive layer 15, and the at least one intervening conductive layer 17.

In some embodiments of the present disclosure, the first laminated waveguide 20 and the second laminated waveguide 30 may have different lengths, widths and heights, wherein the length and width influences the frequency band while the height influences the quality factor. For example, the first laminated waveguide 20 may have a first length L1 and a first width W1 for transmitting and receiving radio frequency signals on a first frequency band, and the second laminated waveguide 30 may have a second length L2 and a second width W2 for transmitting and receiving radio frequency signals on a second frequency band.

Figure 3:
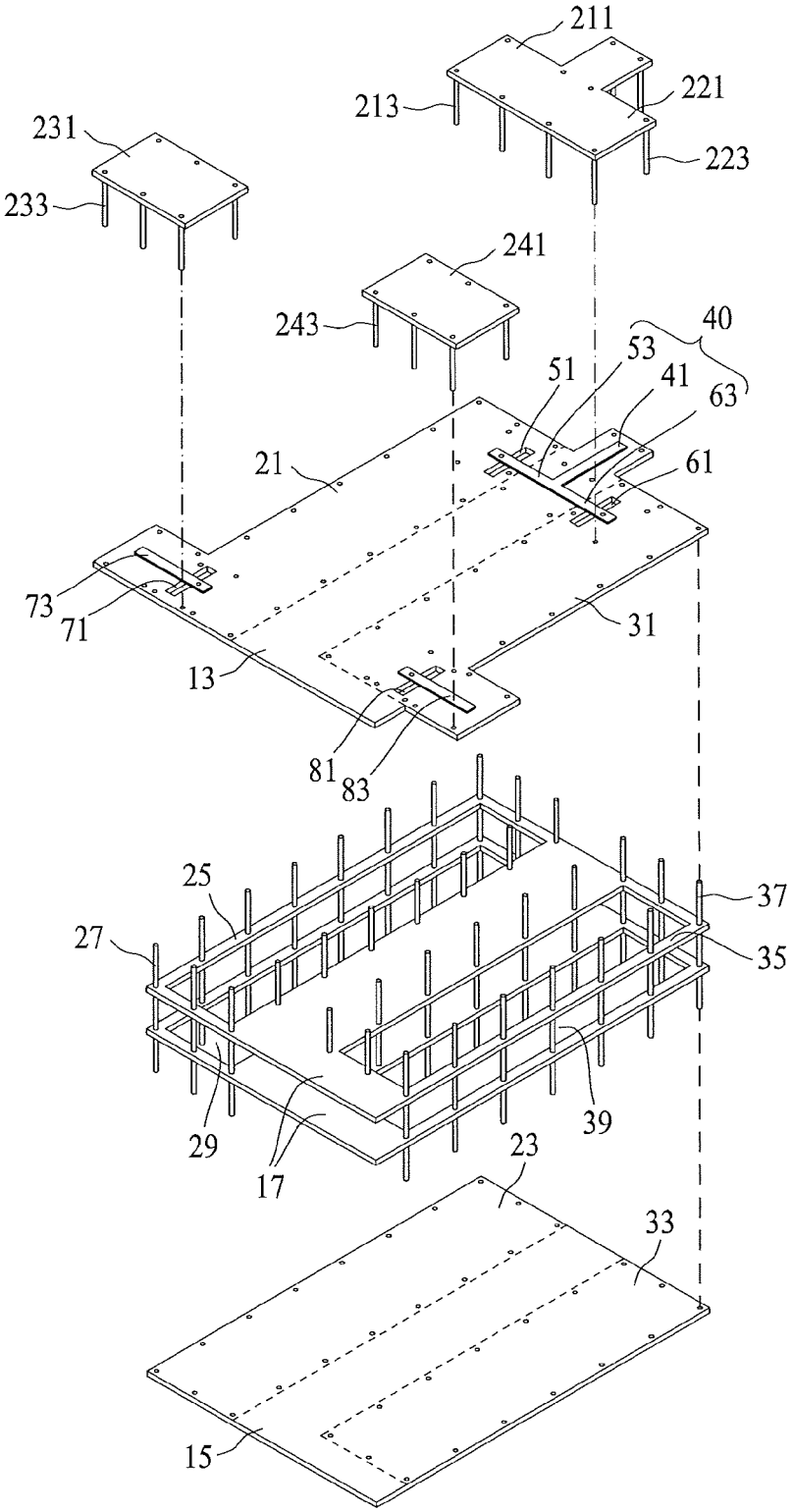
FIG. 3 is an exploded view of the laminated waveguide diplexer in FIG. 2.

FIG. 3 is an exploded view of the laminated waveguide diplexer 10A in FIG. 2. In some embodiments of the present disclosure, the first laminated waveguide 20 comprises a first upper conductor 21, a first bottom conductor 23, at least one first intervening conductor 25 having a first slit 29 disposed between the first bottom conductor 23 and the first upper conductor 21, and a plurality of first conductive posts 27 arranged along a periphery of the first laminated waveguide 20. The first conductive posts 27 connect the first bottom conductor 23, the first intervening conductor 25 and the first upper conductor 21 to form a waveguide structure for transmitting and receiving radio frequency signals. In some embodiments of the present disclosure, the operation frequency band of the waveguide can be further adjusted by the pitch of the posts 27.

Similarly, the second laminated waveguide 30 comprises a second upper conductor 31, a second bottom conductor 33, at least one second intervening conductor 35 having a second slit 39 disposed between the second bottom conductor 33 and the second upper conductor 31, and a plurality of second conductive posts 37 arranged along a periphery of the first laminated waveguide 30. The second conductive posts 37 connect the second bottom conductor 33, the second intervening conductor 35 and the second upper conductor 31 to form a waveguide structure for transmitting and receiving radio frequency signals.

In some embodiments of the present disclosure, the first upper conductor 21 is implemented by a portion of the upper conductive layer 13, and the second upper conductor 31 is implemented by another portion of the upper conductive layer 13. In addition, the first bottom conductor 23 is implemented by a portion of the bottom conductive layer 15, and the second bottom conductor 33 is implemented by another portion of the bottom conductive layer 15. Furthermore, the first intervening conductor 25 with the first slit 29 is implemented by a portion of the intervening conductive layer 17, and the second intervening conductor 35 with the second slit 39 is implemented by another portion of the intervening conductive layer 17.

In some embodiments of the present disclosure, the first laminated waveguide 20 has a first slot 51 in the first upper conductor 21, the second laminated waveguide 30 has a second slot 61 in the second upper conductor 31, and the laminated waveguide diplexer 10A includes a coupling metal 40 having a first line 53 crossing over the first slot 51 and a second line 63 crossing over the second slot 61. In some embodiments of the present disclosure, the first laminated waveguide 20 has a third slot 71 in the first upper conductor 21 and the laminated waveguide diplexer 10A includes a third line 73 crossing over the third slot 71; similarly, the second laminated waveguide 30 comprises a fourth slot 71 in the second upper conductor 31 and the laminated waveguide diplexer 10A includes a fourth line 83 crossing over the fourth slot 81. In some embodiments of the present disclosure, the coupling metal 40 further includes a coupling terminal 41 having a first end configured to couple with the antenna 143 and a second end connected to the first line 53 and the second line 63.

Figure 4:
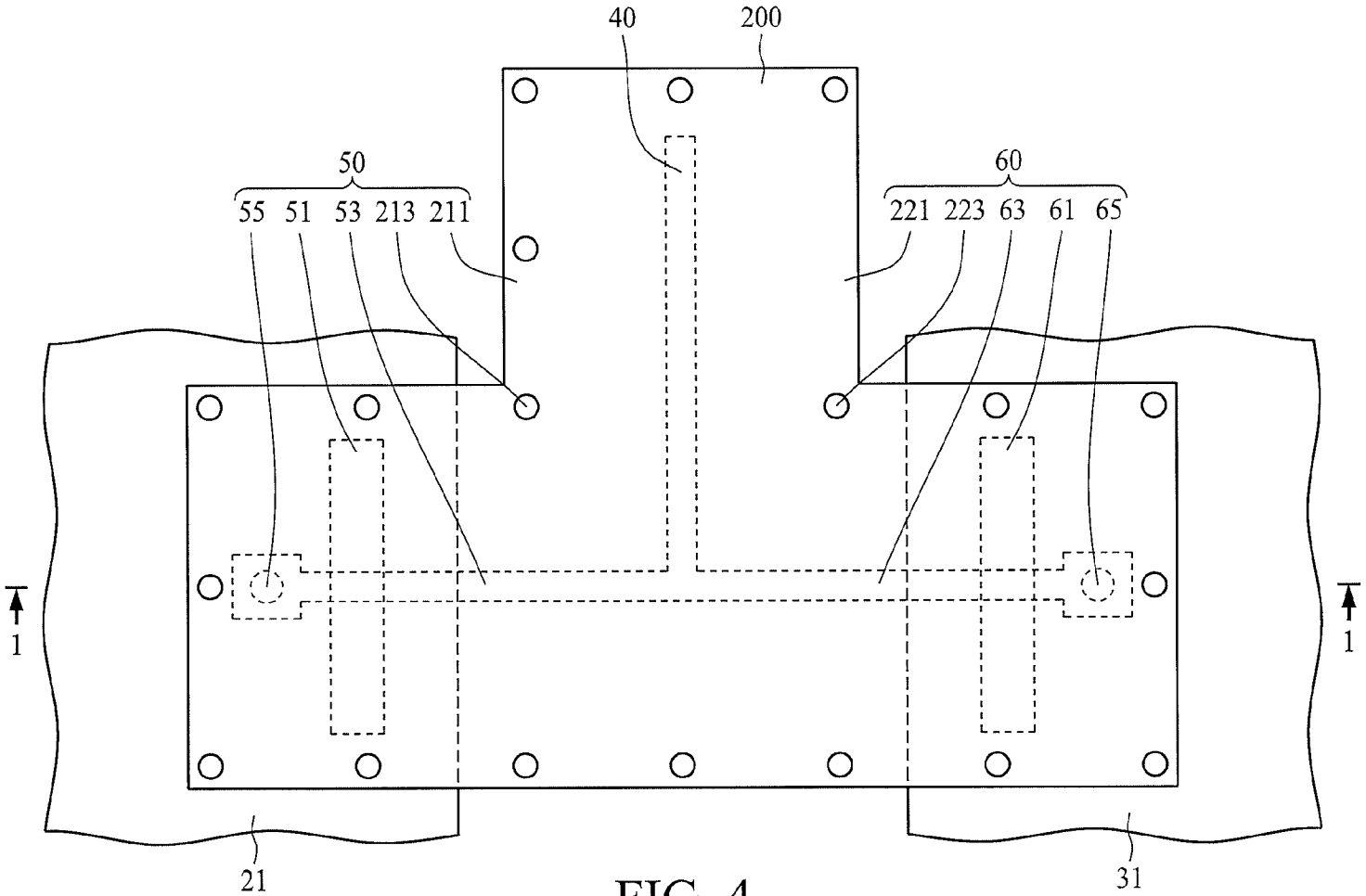
FIG. 4 is a close-up view of the laminated waveguide diplexer in FIG. 2.
Figure 5:
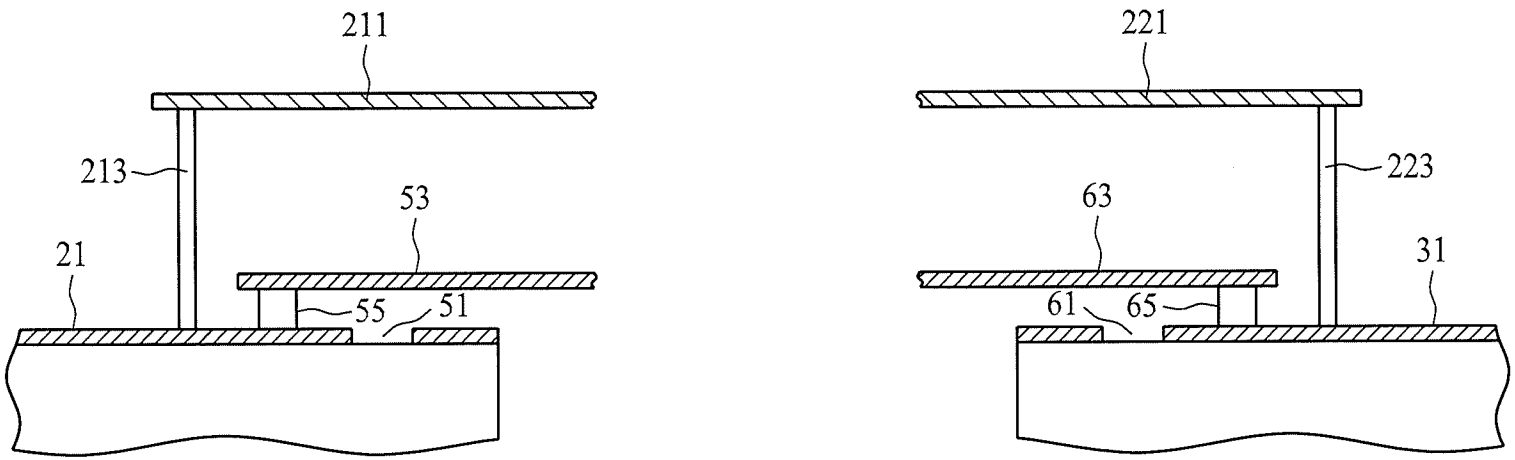
FIG. 5 is a cross-sectional view along cross-sectional line 1-1 in FIG. 4.

FIG. 4 is a close-up view of the laminated waveguide diplexer 10A in FIG. 2, and FIG. 5 is a cross-sectional view along cross-sectional line 1-1 in FIG. 4. In some embodiments of the present disclosure, the first laminated waveguide 20 has a first via 55 connecting the first upper conductor 21 and the first line 53 of the coupling metal 40, and the second laminated waveguide 30 has a second via 65 connecting the second upper conductor 31 and the second line 63 of the coupling metal 40. In some embodiments of the present disclosure, the first via 55 is adjacent to the first slot 51, and the second via 65 is adjacent to the second slot 61, such that the first line 53 and the second line 63 are short stubs for the respective radio frequency signals propagating thereon.

In some embodiments of the present disclosure, the laminated waveguide diplexer 10A comprises a first shielding conductor 211 disposed over the first line 53, a plurality of first conductive pillars 213 connecting the upper conductive layer 13 and the first shielding conductor 211, a second shielding conductor 221 disposed over the second line 63, and a plurality of second conductive pillars 223 connecting the upper conductive layer 13 and the second shielding conductor 223. In some embodiments of the present disclosure, the first shielding conductor 211 and a second shielding conductor 221 are implemented by different parts of a shielding conductive layer 200.

In some embodiments of the present disclosure, the first slot 51, the first line 53, the first via 55, the first shielding conductor 211 and the first pillars 213 form a coupling port 50 of the first laminated waveguide 20. Similarly, the second slot 61, the second line 63, the second via 65, the second shielding conductor 221 and the second pillars 223 form a coupling port 60 of the second laminated waveguide 30. The characteristic impedance of the transmission line can be adjusted by the width of the signal line; the shielded width of the slot by the signal line; and the height from the upper conductor to the signal line.

Figure 6:
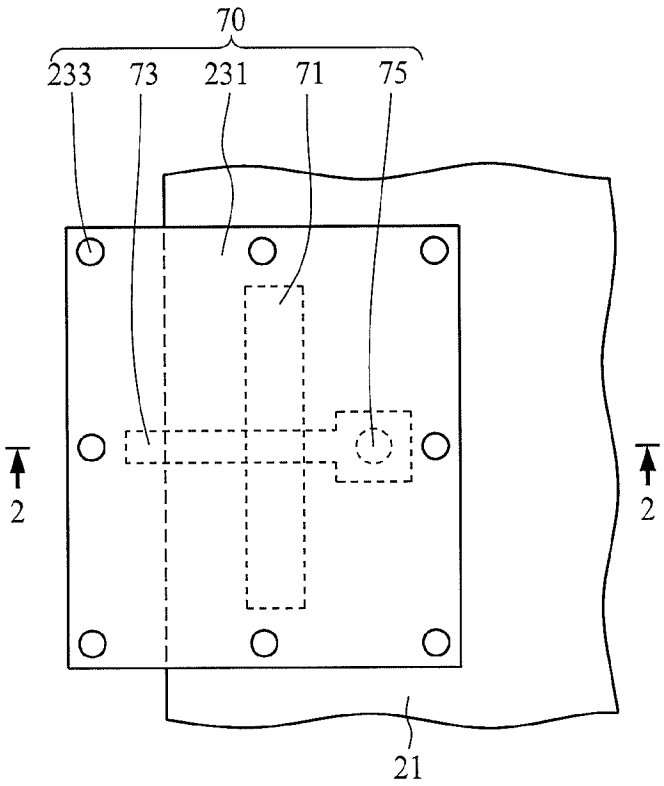
FIG. 6 is a close-up view of the laminated waveguide diplexer in FIG. 2.
Figure 7:
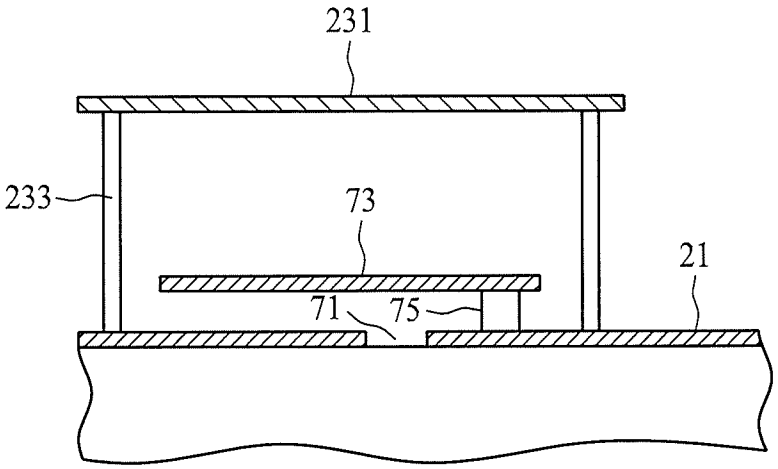
FIG. 7 is a cross-sectional view along cross-sectional line 2-2 in FIG. 6.

FIG. 6 is a close-up view of the laminated waveguide diplexer 10A in FIG. 2, and FIG. 7 is a cross-sectional view along cross-sectional line 2-2 in FIG. 6. In some embodiments of the present disclosure, the first laminated waveguide 20 has a third via 75 connecting the first upper conductor 21 and the third line 73, wherein the third via 75 is adjacent to the third slot 71 such that the third line 73 is a short stub for the radio frequency signals propagating thereon.

In some embodiments of the present disclosure, the first laminated waveguide 20 has a third shielding conductor 231 disposed over the third line 73 and a plurality of third conductive pillars 233 connecting the upper conductive layer 13 and the third shielding conductor 231. In some embodiments of the present disclosure, the third slot 71, the third line 73, the third via 75, the third shielding conductor 231, and the third conductive pillars 233 form a coupling port 70 of the first laminated waveguide 20.

Figure 8:
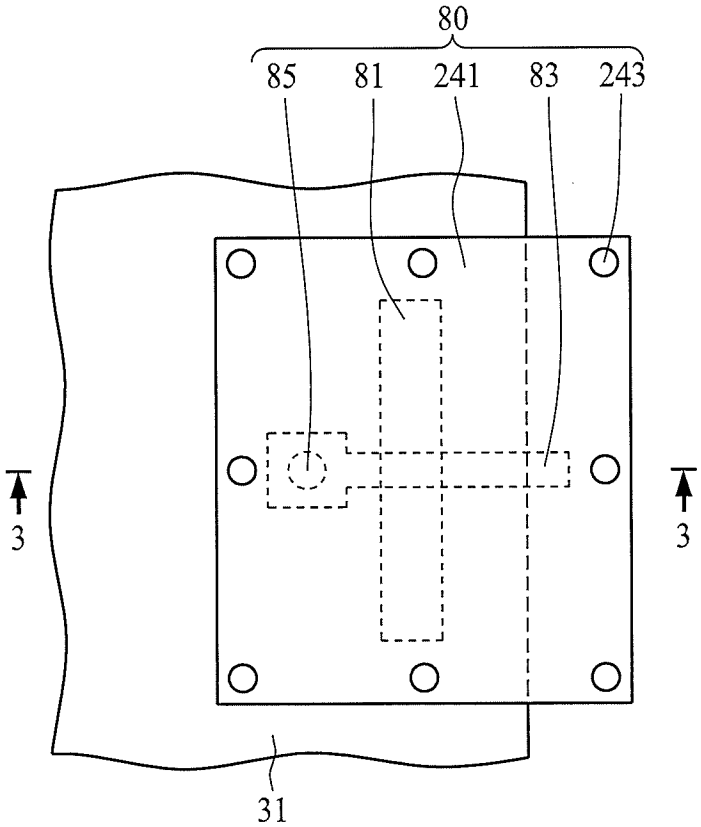
FIG. 8 is a close-up view of the laminated waveguide diplexer 10A in FIG. 2.
Figure 9:
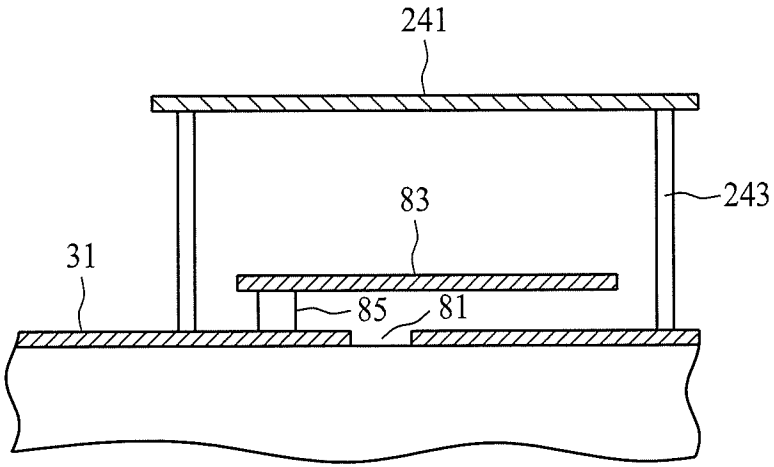
FIG. 9 is a cross-sectional view along cross-sectional line 3-3 in FIG. 8.

FIG. 8 is a close-up view of the laminated waveguide diplexer 10A in FIG. 2, and FIG. 9 is a cross-sectional view along cross-sectional line 3-3 in FIG. 8. In some embodiments of the present disclosure, the second laminated waveguide 30 has a fourth via 85 connecting the second upper conductor 31 and the fourth line 83, wherein the fourth via 85 is adjacent to the fourth slot 81 such that the fourth line 83 is a short stub for the radio frequency signals propagating thereon.

In some embodiments of the present disclosure, the second laminated waveguide 30 has a fourth shielding conductor 241 disposed over the fourth line 83, and a plurality of fourth conductive pillars 243 connecting the upper conductive layer 13 and the fourth shielding conductor 243. In some embodiments of the present disclosure, the fourth slot 81, the fourth line 83, the fourth via 85, the fourth shielding conductor 241, and the fourth conductive pillars 243 form a coupling port 80 of the second laminated waveguide 30. In some embodiments of the present disclosure, the third shielding conductor 231 and the fourth shielding conductor 241 are implemented by different parts of the shielding conductive layer 200.

In some embodiments of the present disclosure, the first line 53 serves as a signal-inputting terminal and the third line 73 serves as a signal-outputting terminal for the first laminated waveguide 20. In addition, the fourth line 83 serves as a signal-inputting terminal and the second line 63 serves as a signal-outputting terminal for the second laminated waveguide 30; and vice versa. In some embodiments of the present disclosure, the characteristic impedance of the signal lines can be adjusted by changing the width of the signal line, the shielding width of the shielding conductor over the signal line, and the shielding height of the shielding conductor over the signal line.

Consequently, the laminated waveguide diplexer 10A can use the first laminated waveguide 20 to transmit the radio frequency signals from the antenna 143 to the transceiver block 120 and use the second laminated waveguide 30 to transmit the frequency signals from the transceiver block 120 to the antenna 143. In addition, the first laminated waveguide 20 and the second laminated waveguide 30 are bidirectional devices, i.e., the second laminated waveguide 30 can be used to transmit the radio frequency signals from the antenna 143 to the transceiver block 120 and the first laminated waveguide 20 can be used to transmit second frequency signals from the transceiver block 120 to the antenna 143.

Figure 10:
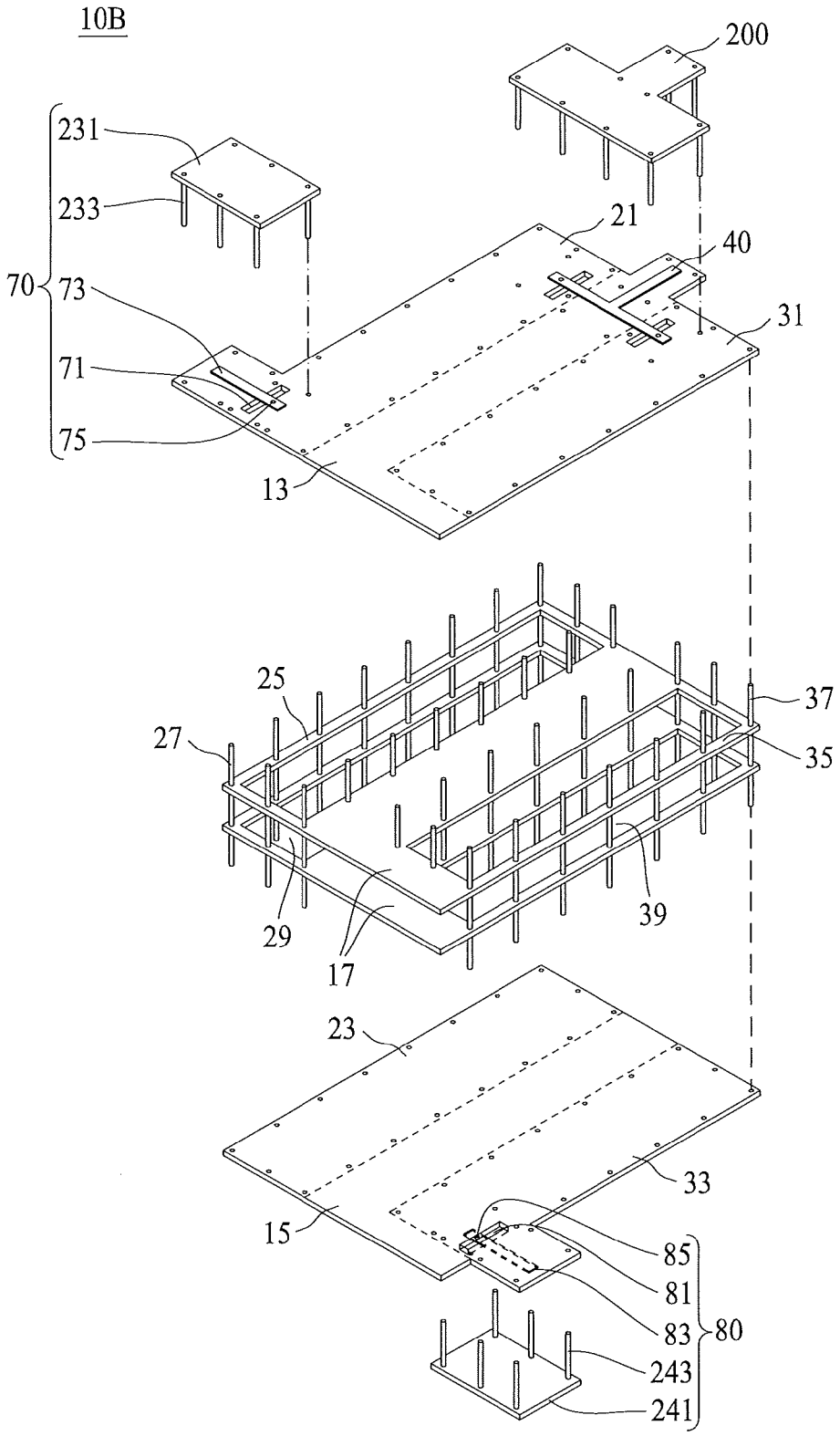
FIG. 10 illustrates a schematic view of a laminated waveguide diplexer for transmitting and receiving radio frequency signals on different frequency bands according to some embodiments of the present disclosure.

FIG. 10 illustrates a schematic view of a laminated waveguide diplexer 10B for transmitting and receiving radio frequency signals on different frequency bands according to some embodiments of the present disclosure, wherein the diplexer 141 in FIG. 1 can be implemented by the laminated waveguide diplexer 10B. In contrast to the laminated waveguide diplexer 10A shown in FIG. 2 having the coupling port 80 disposed in the second upper conductor 31, the coupling port 80 of the laminated waveguide diplexer 10B is disposed in the second bottom conductor 33.

Figure 11:
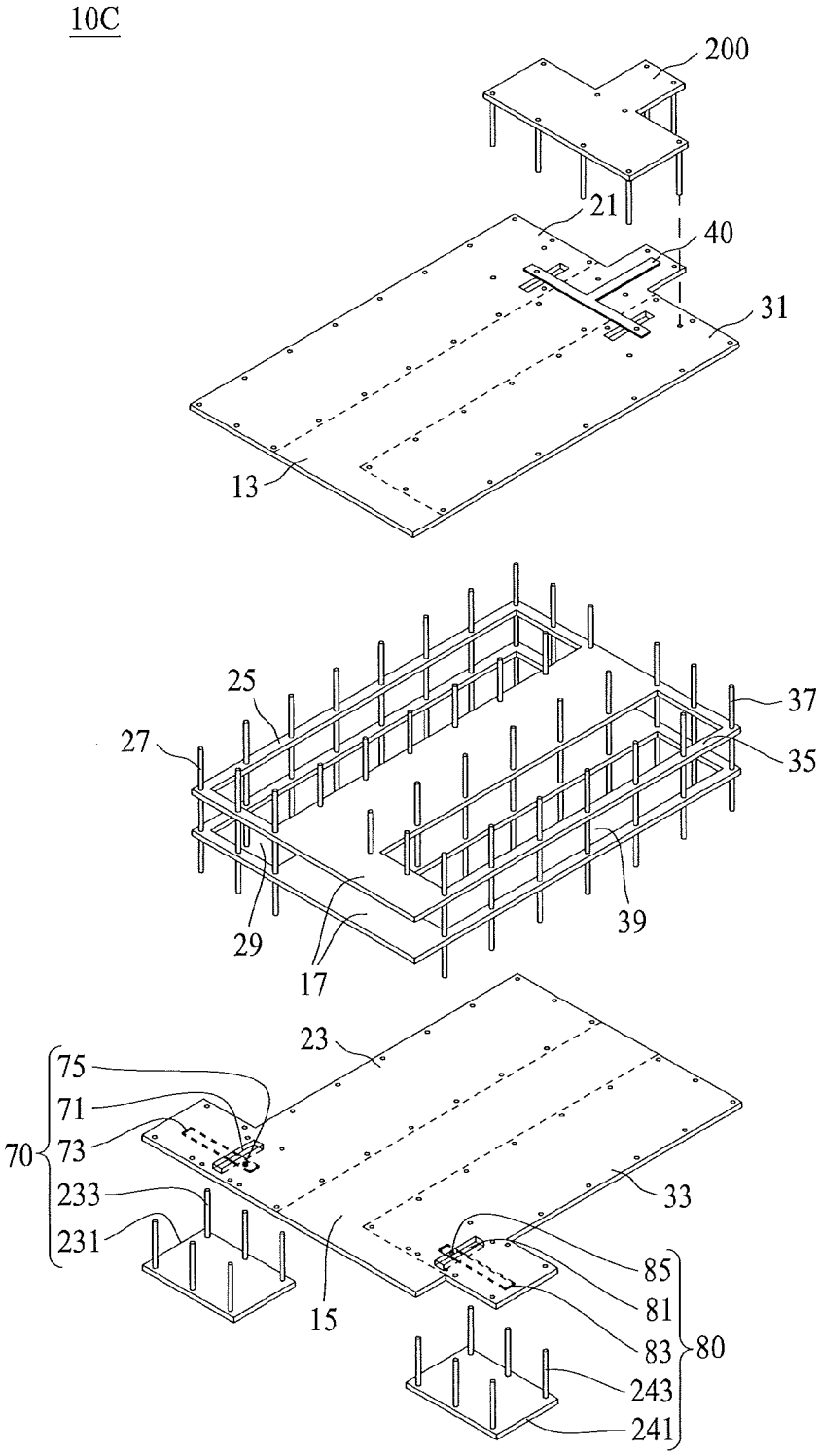
FIG. 11 illustrates a schematic view of a laminated waveguide diplexer for transmitting and receiving radio frequency signals on different frequency bands according to some embodiments of the present disclosure.

FIG. 11 illustrates a schematic view of a laminated waveguide diplexer 10C for transmitting and receiving radio frequency signals on different frequency bands according to some embodiments of the present disclosure, wherein the diplexer 141 in FIG. 1 can be implemented by the laminated waveguide diplexer 10C. In contrast to the laminated waveguide diplexer 10A shown in FIG. 2 having the coupling port 70 and the coupling port 80 disposed respectively in the first upper conductor 21 and the second upper conductor 31, the coupling port 70 and the coupling port 80 of the laminated waveguide diplexer 10C are disposed in the first bottom conductor 23 and the second bottom conductor 33, respectively.

In some embodiments of the present disclosure, copper or copper alloy, among the other conductive materials, can also be used to form the upper conductive layer 13, the intervening conductive layer 17, the bottom conductive layer 15, the coupling metal 40, the third line 73 and the fourth line 83. In addition, a low temperature co-fired ceramic (LTCC) is used to separate the above-mentioned conductive elements according to some embodiments of the present disclosure.

Figure 12:
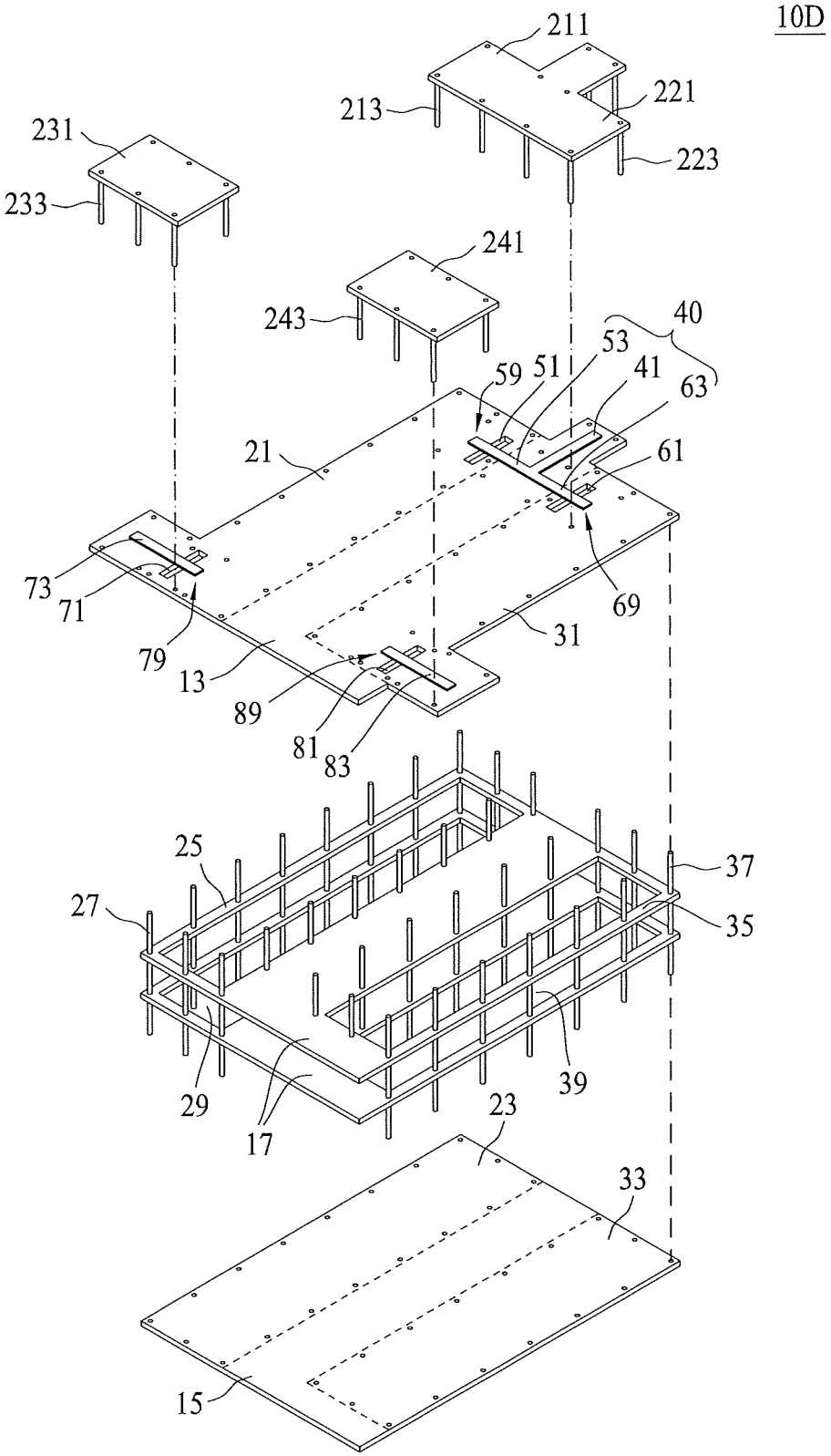
FIG. 12 illustrates a schematic view of a laminated waveguide diplexer for transmitting and receiving radio frequency signals on different frequency bands according to some embodiments of the present disclosure.

FIG. 12 illustrates a schematic view of a laminated waveguide diplexer 10D for transmitting and receiving radio frequency signals on different frequency bands according to some embodiments of the present disclosure, wherein the diplexer 141 in FIG. 1 can be implemented by the laminated waveguide diplexer 10D.

In the laminated waveguide diplexer 10A shown in FIG. 3, the first via 55 is adjacent to the first slot 51 such that the first line 53 is a short stub for the first radio frequency signals propagating thereon, the second via 65 is adjacent to the second slot 61 such that the second line 63 is a short stub for the second radio frequency signals propagating thereon, the third via 75 is adjacent to the third slot 71 such that the third line 73 is a short stub for the first radio frequency signals propagating thereon, and the fourth via 85 is adjacent to the fourth slot 81 such that the fourth line 83 is a short stub for the second radio frequency signals propagating thereon. In contrast, the laminated waveguide diplexer 10D shown in FIG. 12 do not have corresponding vias.

In some embodiments of the present disclosure, the length of the first line 53 is designed to serve as an open stub for the first radio frequency signals propagating thereon, the length of the second line 63 is designed to serve as an open stub for the second radio frequency signals propagating thereon, the length of the third line 73 is designed to serve as an open stub for the first radio frequency signals propagating thereon, and the length of the fourth line 83 is designed to serve as an open stub for the second radio frequency signals propagating thereon. Similarly, the laminated waveguide diplexer 10B shown in FIG. 10 and the laminated waveguide diplexer 10C shown in FIG. 11 can use the open stub design in the signal transmission line. In other words, the signal transmission line in the embodiments of the present application can optionally use the open stub design or the short stub design.

Figure 13:
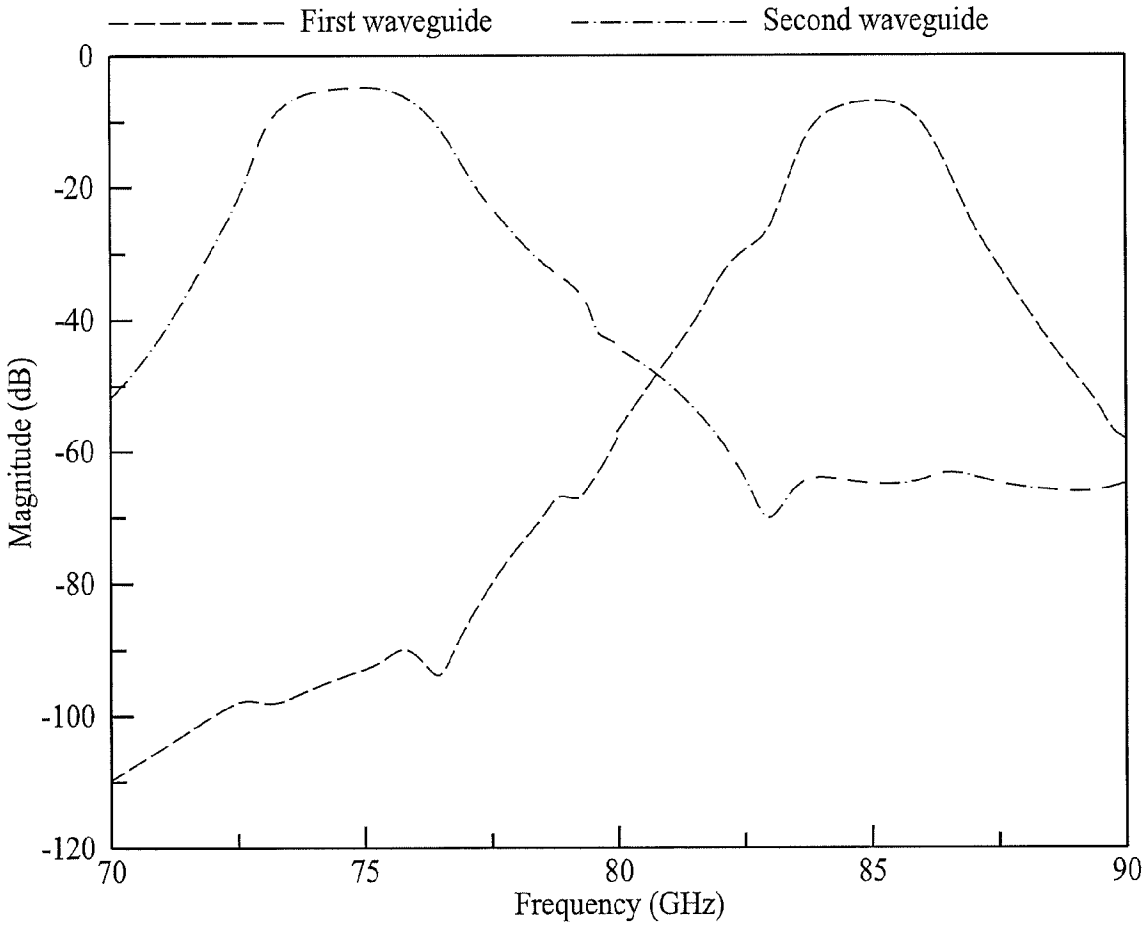
FIG. 13 is a measured frequency response diagram of the laminated waveguide diplexer in FIG. 2.

FIG. 13 is a measured frequency response diagram of the laminated waveguide diplexer 10A in FIG. 2, wherein the waveform with crosses represents the signal response of the first laminated waveguide 20, and the waveform with dots represents the signal response of the second laminated waveguide 30. Referring to FIG. 2 and FIG. 12, in some embodiments of the present disclosure, the first laminated waveguide 20 and the second laminated waveguide 30 have different lengths for transmitting and receiving radio frequency signals on different frequency bands; for example, the first laminated waveguide 20 has the first length L1 with a pass-band in a range from 74 GHz to 76 GHz, and the second laminated waveguide 30 has the second length L2 with a pass-band in a range from 84 GHz to 86 GHz.

In addition, the signal magnitude of the second laminated waveguide 30 in the pass-band (74 GHz to 76 GHz) of the first laminated waveguide 20 is substantially lower than −90 dB, i.e., the signals propagating through the first laminated waveguide 20 are not influenced by the signals propagating through the second laminated waveguide 30. Similarly, the signal magnitude of the first laminated waveguide 20 in the pass-band (84 GHz to 86 GHz) of the second laminated waveguide 30 is substantially lower than −60 dB, i.e., the signals propagating through the second laminated waveguide 30 are not influenced by the signals propagating through the first laminated waveguide 20.

As a result, the laminated waveguide diplexer can operate in two separated frequency bands instead of a single frequency band; for example, the laminated waveguide diplexer can use one of the two laminated waveguides to receive radio frequency signals on a first frequency band and use another laminated waveguide to transmit radio frequency signals on a second frequency band.

Although the present disclosure and its advantages have been described in detail, it should be understood that various changes, substitutions and alterations can be made herein without departing from the spirit and scope of the disclosure as defined by the appended claims. For example, many of the processes discussed above can be implemented in different methodologies and replaced by other processes, or a combination thereof.

Moreover, the scope of the present application is not intended to be limited to the particular embodiments of the process, machine, manufacture, composition of matter, means, methods and steps described in the specification. As one of ordinary skill in the art will readily appreciate from the disclosure of the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A laminated waveguide diplexer, comprising:

an upper conductive layer having a first slot and a second slot;

a first line crossing over the first slot;

a first shielding conductor disposed over the first line;

a plurality of first conductive pillars connecting the upper conductive layer and the first shielding conductor;

a second line crossing over the second slot;

a second shielding conductor disposed over the second line; and a plurality of second conductive pillars connecting the upper conductive layer and the second shielding conductor.

2. The laminated waveguide diplexer of claim 1, comprising:

a bottom conductive layer;

at least one intervening conductive layer having a first slit and a second slit disposed between the upper conductive layer and the bottom conductive layer;

a plurality of first conductive posts arranged along a periphery of the first slit, wherein the first conductive posts connect the upper conductive layer, the at least one intervening conductive layer and the bottom conductive layer; and a plurality of second conductive posts arranged along a periphery of the second slit, wherein the second conductive posts connect the upper conductive layer, the at least one intervening conductive layer and the bottom conductive layer.

3. The laminated waveguide diplexer of claim 1, further comprising:

a first via connecting the upper conductive layer and the first line, wherein the first via is adjacent to the first slot, and the first line is a short stub for first radio frequency signals propagating thereon; and a second via connecting the upper conductive layer and the second line, wherein the second via is adjacent to the second slot, and the second line is a short stub for second radio frequency signals propagating thereon.

4. The laminated waveguide diplexer of claim 2, further comprising:

a third line crossing over a third slot in the upper conductive layer;

a third shielding conductor disposed over the third line; and a plurality of third conductive pillars connecting the upper conductive layer and the third shielding conductor.

5. The laminated waveguide diplexer of claim 4, further comprising:

a third via connecting the upper conductive layer and the third line; and wherein the third via is adjacent to the third slot, and the third line is a short stub for the first radio frequency signals propagating thereon.

6. The laminated waveguide diplexer of claim 4, further comprising:

a fourth line crossing over a fourth slot in the upper conductive layer;

a fourth shielding conductor disposed over the fourth line; and a plurality of fourth conductive pillars connecting the upper conductive layer and the fourth shielding conductor.

7. The laminated waveguide diplexer of claim 6, further comprising:

a fourth via connecting the upper conductive layer and the fourth line; and wherein the fourth via is adjacent to the fourth slot, and the fourth line is a short stub for the second radio frequency signals propagating thereon.

8. The laminated waveguide diplexer of claim 6, further comprising:

a fourth line crossing over a fourth slot in the bottom conductive layer;

a fourth shielding conductor disposed over the fourth line; and a plurality of fourth conductive pillars connecting the bottom conductive layer and the fourth shielding conductor.

9. The laminated waveguide diplexer of claim 8, further comprising:

a fourth via connecting the bottom conductive layer and the fourth line; and wherein the fourth via is adjacent to the fourth slot, and the fourth line is a short stub for the second radio frequency signals propagating thereon.

10. The laminated waveguide diplexer of claim 2, further comprising:

a third line crossing over a third slot in the bottom conductive layer;

a third shielding conductor disposed below the third line; and a plurality of third conductive pillars connecting the bottom conductive layer and the third shielding conductor.

11. The laminated waveguide diplexer of claim 10, further comprising:

a third via connecting the bottom conductive layer and the third line; and wherein the third via is adjacent to the third slot, and the third line is a short stub for the first radio frequency signals propagating thereon.

12. The laminated waveguide diplexer of claim 10, further comprising:

a fourth line crossing over a fourth slot in the bottom conductive layer;

a fourth shielding conductor disposed below the fourth line; and a plurality of fourth conductive pillars connecting the bottom conductive layer and the fourth shielding conductor.

13. The laminated waveguide diplexer of claim 12, further comprising:

a fourth via connecting the bottom conductive layer and the fourth line; and wherein the fourth via is adjacent to the fourth slot, and the fourth line is a short stub for the second radio frequency signals propagating thereon.

14. The laminated waveguide diplexer of claim 1, further comprising a coupling terminal having a first end configured to couple with an antenna and a second end connected to the first line and the second line.

15. The laminated waveguide diplexer of claim 14, wherein the first line serves as a signal-inputting terminal of a first laminated waveguide and the second line serves as a signal-outputting terminal of a second laminated waveguide.

16. The laminated waveguide diplexer of claim 1, wherein the first shielding conductor and the second shielding conductor are different parts of a shielding conductive layer.

17. The laminated waveguide diplexer of claim 1, comprising a first laminated waveguide and a second laminated waveguide having different lengths.

18. The laminated waveguide diplexer of claim 1, comprising a first laminated waveguide and a second laminated waveguide have different widths.

* * * * *